US006484681B2

(12) United States Patent
Kuroda

(10) Patent No.: US 6,484,681 B2
(45) Date of Patent: Nov. 26, 2002

(54) OUTBOARD MOTOR

(75) Inventor: Tatsuya Kuroda, Saitama-ken (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/930,732

(22) Filed: Aug. 15, 2001

(65) Prior Publication Data

US 2002/0040698 A1 Apr. 11, 2002

(30) Foreign Application Priority Data

Aug. 25, 2000 (JP) ..... 2000-256508

(51) Int. Cl.[7] ..... F01M 1/06

(52) U.S. Cl. ..... 123/90.33; 123/90.38; 123/196 R; 123/196 W

(58) Field of Search ..... 123/90.12, 90.15, 123/90.16, 90.17, 90.33, 90.36, 90.38, 196 R, 196 W, 196 P; 440/88, 89

(56) References Cited

U.S. PATENT DOCUMENTS 5,143,034 A * 9/1992 Hirose ..... 123/196 R

FOREIGN PATENT DOCUMENTS

JP 08093585 A 4/1996

* cited by examiner

*Primary Examiner*—Thomas Denion
*Assistant Examiner*—Jaime Corrigan
(74) *Attorney, Agent, or Firm*—Carrier, Blackman & Associates, P.C.; Joseph P. Carrier; William D. Blackman

(57) ABSTRACT

An outboard motor, which is improved for higher output energy, lower fuel consumption, and also simplified in layout of oil paths and facilitating maintenance of hydraulic control valves, includes an engine with a crank shaft, an engine body mounted to a mount case, and a valve driving mechanism for opening and closing intake valves and exhaust valves. The valve driving mechanism includes a valve operating characteristics variable mechanism of an hydraulic type, which changes operating characteristics of the intake and/or exhaust valves in accordance with the revolution speed of the engine. A hydraulic oil path for supplying the valve operating characteristics variable mechanism with hydraulic oil branches from a lubricant oil path for supplying bearing portions of a crank shaft and the valve driving mechanism with lubricant oil.

14 Claims, 8 Drawing Sheets

OUTBOARD MOTOR

BACKGROUND OF THE INVENTION

1. Field of the Invention

This invention relates to an outboard motor having an internal combustion engine including a valve operating characteristics variable mechanism that changes operating characteristics of intake valves and exhaust valves in response to the revolution speed of the engine.

2. Description of the Related Art

Also for engines of outboard motors, efforts have been made for higher outputs. For example, there is a trial of enhancing the air intake and exhaust efficiency to increase the output by providing a plurality of intake/exhaust valves in each cylinder (see Japanese Patent Laid-Open Publication No. hei 8-93585). There is also a valve operating characteristics variable mechanism brought into practice, which changes operating characteristics of intake/exhaust valves in response to the revolution speed range of the engine for the purpose of attaining higher output and lower fuel consumption of a vehicle engine. This valve operating characteristics variable mechanism is hydraulic, in which hydraulic pressure of its operating section is controlled by a hydraulic control valve.

Outboard engines are often driven continuously in different revolution speed ranges, such as in a trolling condition under a low revolution of the engine or in a cruising condition under a high revolution of the engine. However, conventional outboard motors are each monotonous in lifting amount and valve-opening period, which are operating characteristics of intake valves and exhaust valves, throughout the entire revolution ranges of the engine. Therefore, a lifting amount and a valve-opening period exhibiting high output characteristics in a specific revolution range, such as in a low revolution range (or high revolution range), might not be optimum in a revolution range different from that specific revolution range, such as in a high revolution range (or low revolution range), and this invites a decrease of the output or deterioration of fuel efficiency in the high revolution range (or low revolution range).

Toward higher output and higher fuel efficiency, it would be possible to employ the above-mentioned valve operating characteristics variable mechanism for vehicles. However, if it is used in an outboard motor whose compact engine is housed in a narrow space within an engine cover, simplification of oil paths and convenience for maintenance of control valves arise as new problems.

SUMMARY OF THE INVENTION

It is therefore a general object of the invention to provide an outboard motor capable of enhancing output energy and increasing the fuel efficiency by means of a hydraulic valve operating characteristics variable mechanism and also capable of simplifying oil paths and facilitating maintenance of hydraulic control valves.

A further object of the invention is to improve the accuracy of a bearing and facilitate maintenance of an oil filter.

A still further object of the invention is to facilitate assemblage of hydraulic control valves.

According to the invention, there is provided an outboard motor having an engine which includes an engine body mounted to a mount case with a mount wall portion of the engine body and defining a crank chamber containing a vertically extending crank shaft and bearing portions rotatably supporting the crank shaft, an intake valve and an exhaust valve for opening and closing an intake opening and an exhaust opening, respectively, which open to a combustion chamber, and a valve driving mechanism for opening and closing the intake valve and the exhaust valve, characterized in that:

at least one of the intake and exhaust valves being a plurality of such valves for each cylinder of the engine, the valve driving mechanism including an hydraulic-driven valve operating characteristics variable mechanism which changes operating characteristics of at least one of said intake and exhaust valves among the plurality of intake valves or exhaust valves in accordance with the revolution speed of the engine, an hydraulic oil path for supplying the valve operating characteristics variable mechanism with hydraulic oil being branched at a branching portion from a lubricant oil path for supplying the bearing portions and the valve driving mechanism with lubricant oil released from an oil pump driven by the engine, the branching portion being formed in a wall portion of the engine body other than the mount wall portion, and a hydraulic control valve for controlling pressure of hydraulic oil at the branching portion.

According to the invention summarized above, since at least one intake valve or exhaust valve among a plurality of intake valves or exhaust valves of each cylinder is changed in operating characteristics by the valve operating characteristics variable mechanism in accordance with the revolution speed of the engine, optimum operation characteristics can be set in different revolution ranges from the viewpoint of realizing higher output energy and lower fuel consumption. Additionally, since the hydraulic control valve is provided in the wall portion of the engine body other than the mount wall portion having a mount surface for engagement with the mount case, maintenance of the hydraulic control valve is possible without removing the engine.

Further, since the hydraulic control valve is located at the branching portion of the hydraulic oil path that branches from the lubricant oil path for supplying the bearing portion of the crank shaft and the valve driving mechanism with lubricant oil, length of the hydraulic oil path from the hydraulic control valve can be decreased. This results in elongating the portion of the oil path from the oil pump to the branching portion, which can be commonly used as the oil path of the lubricant oil for lubrication and as the oil path for hydraulic oil. Therefore, arrangement of the lubricant oil path and the hydraulic oil path can be simplified, and an increase of the cost caused by formation of the hydraulic oil path can be prevented.

An engine oil path forming a part of the lubricant oil path and an oil filter for lubricant oil flowing in the engine body oil path to pass through may be formed in the engine body. In this case, the branching portion is located in the lubricant oil path downstream of the oil filter.

In this arrangement, since the hydraulic oil is clean lubricant oil freed from foreign matters by the oil filter, foreign matters once entering into the lubricant oil do not intrude to the spool valve and the valve operating characteristics variable mechanism, and these components keep properly operative for a longer period, which also makes the maintenance easier.

The engine body may have a cylinder block and a crank case that partly define the crank chamber, the bearing portion may be made up of the cylinder block and a bearing cap, and the oil filter may be disposed in the crank case that forms the front wall portion of the engine body.

In this arrangement, since the use of the bearing cap makes it possible to precisely set the leakage of lubricant oil at the bearing portion, it contributes to improving the accuracy of the bearing and ensuring rigidity of the bearing portion more easily.

The cylinder block may have a deep skirt portion and the wall portion may be a cover that is fixed to the cylinder block to form a part of the upper wall portion of the engine body and permits the crank shaft projecting from the crank chamber to pass through. Additionally, a case oil path formed in the crank case among oil paths making up the engine body oil path may be connected to a block oil path formed in the cylinder block via a cover oil path formed in the cover.

In this arrangement, since the branching portion is formed in the cover that constitutes the upper wall portion of the engine body, maintenance of the hydraulic control valve is made easier. Additionally, when the hydraulic control valve is previously attached to the cover integrally, the hydraulic control valve and the cover can be prepared as a unit, and this facilitates assembly of the hydraulic control valve in the engine body.

In so far as used in this specification, the terms "front, back, left and right" indicate those of a ship body to which the outboard motor is mounted unless particularly indicated otherwise.

DESCRIPTION OF THE PREFERRED EMBODIMENTS

An embodiment of the invention will now be explained with reference to FIGS. 1 through 10.

Figure 1:
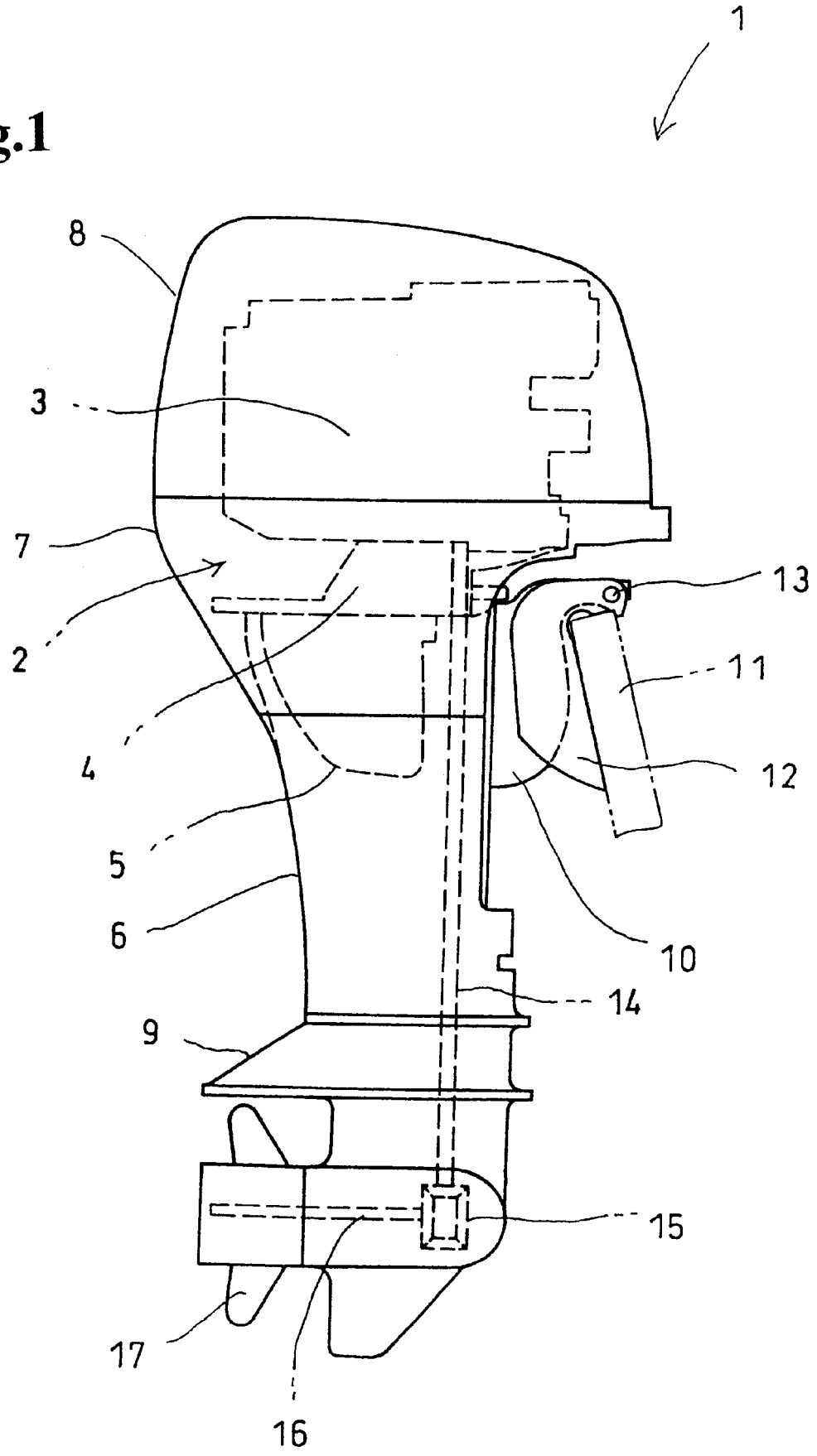
FIG. 1 is a general overall view of an outboard motor according to an embodiment of the invention.

FIG. 1 is a general overall view of an outboard motor according to an embodiment of the invention. The outboard motor 1 includes an engine 2 having a crank shaft 24 (see FIG. 2) extending in the up-and-down directions. The engine body 3 of the engine 2, which will be explained later, is supported by a mount case 4, and coupled to the lower end of the mount case 4 are an oil pan 5 and an extension case 6 configured to accommodate the oil pan 5. An undercover 7 is connected to the top of the extension case 6, and an engine cover 8 is connected to the top end of the under cover 7 to cover the engine 2. Thus the undercover 7 and the engine cover 8 form an engine room for housing the engine body 3. A gear case 9 is connected to the bottom end of the extension case 6 to accommodate a forward/backward movement switching device 15.

A swivel shaft (not shown) fixed to the mount case 4 of the outboard motor 1 is supported by a swivel case 10 for pivotal movements in the right and left directions. The swivel case 10 is supported on a tilt shaft 13 fixed on the top of a stern bracket 12 integrally fixed to the ship body for swinging movements in the up-and-down directions. Thus the outboard motor 1 can be pivot horizontally about the swivel shaft and can also lean vertically about the tilt shaft 13.

A drive shaft 14 is integrally coupled to the bottom of the crank shaft 24. The drive shaft 14 extends through the extension case 6 into the gear case 9, and the bottom end of the drive shaft 14 is connected to a propeller shaft 16 having propellers via the forward/backward movement switching device 15 inside the gear case 9. Therefore, driving power of the engine 2 is transmitted to the propellers 17 via the crank shaft 24, drive shaft 14, forward/backward movement switching device 15 and propeller shaft 16, thereby to rotate the propellers 17.

Figure 2:
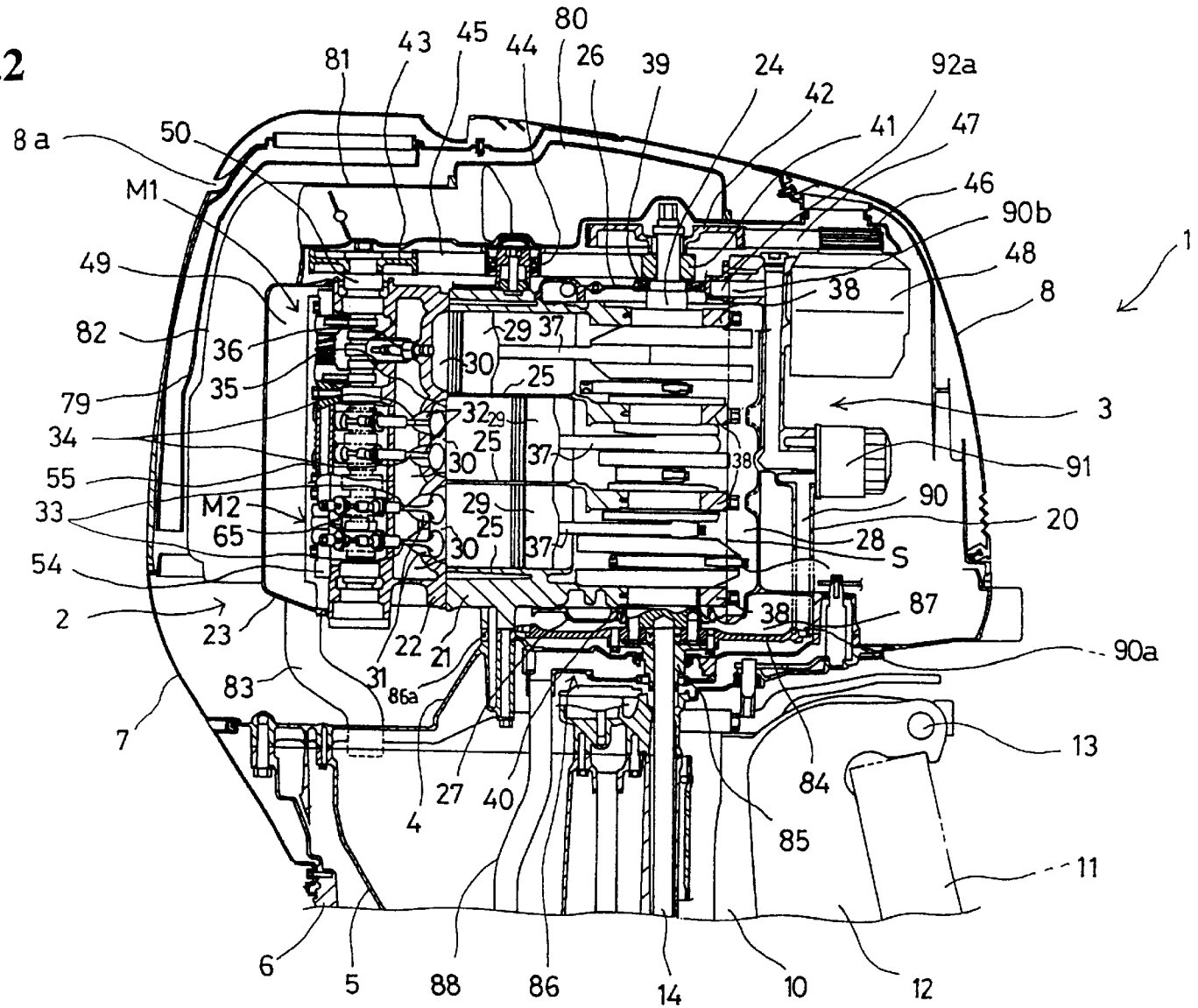
FIG. 2 is a fragmentary cross-sectional view of the outboard motor of FIG. 1, taken along a vertical plane approximately including the rotation axis of a crank shaft and the center lines of cylinders in the left bank.

The engine 2 is further explained with reference to FIG. 2. The engine 2 is a V-type, six-cylinder, water-cooled, SOHC, four-cycle, internal combustion engine, and its engine body 3 is made up of the crank case 20, cylinder block 21, cylinder heads 22 of respective banks, head cover 23, upper seal cover 26, which will be explained later, and lower seal cover 27, which will be explained later. These crank case, 20, cylinder block 21, cylinder heads 22 and head cover 23 are united together by sequentially assembling them from the front to the back of the ship body 11. The engine body 3 has wall portions forming the contour of the engine body 3. The wall portions are an upper wall portion forming the top surface of the engine body 3, a lower wall portion forming the bottom surface thereof, and side wall portions which are the wall portions other than the upper and lower wall portions and form side wall surfaces including front, back, right and left end surfaces.

A pair of banks of the cylinder block 21 is V-shaped and opens backward when viewed in a plan view. Each bank is made up of three cylinders 25 aligned vertically along the crank shaft 24. The cylinder block 21 is a so-called deep skirt type cylinder block whose right and left side wall surfaces extend forward beyond the rotation axis of the crank shaft 24 and have fitting surfaces S for fitting the end of the connecting rods 37 at a location nearer to the crank case 20 than the rotation axis of the crank shaft 24. Therefore, the upper seal cover 26 and the lower seal cover 27 having holes permitting the crank shaft 24 to pass through are joined to the upper and lower wall portions of the cylinder block 21 by applying bolts to the cylinder block 21 and the crank case 20 on a plane common to the fitting surfaces S. Therefore, the crank case 20 is joined at its upper and lower wall portions to the upper seal cover 26 and lower seal cover 27 with bolts, and joined at its side wall portions to the cylinder block 21 with bolts, such that these cylinder block 21, both seal covers 26, 27 and crank case 20 make up a crank chamber 28.

The cylinder head 22 of each bank has formed, for each cylinder 25, an intake port having a pair of intake openings 31 that open to a combustion chamber 30 formed between the cylinder head 22 and the piston 29 slidably received in the cylinder 25, and an exhaust port having a pair of exhaust openings 32 that open to the combustion chamber 30. At a portion of the cylinder head 22, associated with each cylinder 25, there are provided a pair of intake valves 33 for opening and closing a pair of intake openings 31 and a pair of exhaust valves 34 for opening and closing a pair of exhaust opening 32. Spark plugs 36 contained in container tubes 35 are further provided to face toward the center of the combustion chambers 30.

The piston 29 is connected to the crank shaft 24 via conrod (connecting rod) 37, and the crank shaft 24 is rotated by the piston 29 that reciprocates. Four journals of the crank shaft 24 are supported by the cylinder block 21 and bearing caps 38 attached to the cylinder block 21 via plane bearings such that the crank shaft 24 is rotatably supported by the cylinder block 21. Therefore, bearing portions of the crank shaft 24 are made up of the cylinder block 21 and the bearing caps 38. For the purpose of sealing the holes of the upper seal cover 26 and the lower seal cover 27 where the crank shaft 24 passes through, oil seals 39, 40 are provided on the inner wall surfaces of respective holes.

To the top end of the crank shaft 24 projecting upward from the upper seal cover 26 forming a part of the crank chamber 28, a first drive pulley 41 is connected adjacent to the upper seal cover 26, and a second drive pulley 42 thereon. A timing belt 45 is provided to wrap the first drive pulley 41, a pair of follower pulleys 43 coupled to top ends of a pair of cam shafts 50 rotatably supported to the cylinder heads 22 of both cylinder banks and extending vertically, and an idler pulley 44, and cam shafts 50 of both banks are driven and rotated via the timing belt 45 in the reduction ratio of 1/2 of the crank shaft 24. On the other hand, a drive belt 47 is wound to wrap the second drive pulley 42 and the second follower pulley 46 connected to the top end of the rotating shaft of an AC generator 48, and the rotating shaft is driven and rotated by the crank shaft 24 via the drive belt 47.

In each bank, inside a valve driving chamber 49 defined by the cylinder head 22 and the head cover 23, a valve driving mechanism M1 is housed, which is made up of a cam shaft 50 extending in up and down directions, rocker shafts 54, 55, and rocker arm supported by the rocker shafts 54, 55 to be swung by cams 51, 52, 53 formed around the cam shaft 50. The valve driving mechanism M1 is further provided with a valve operation characteristics variable mechanism M2 for changing operating characteristics, i.e. lifting amounts and valve opening periods in this embodiment, of a pair of intake valves 33 in response to the revolution speed of the engine.

Figure 3:
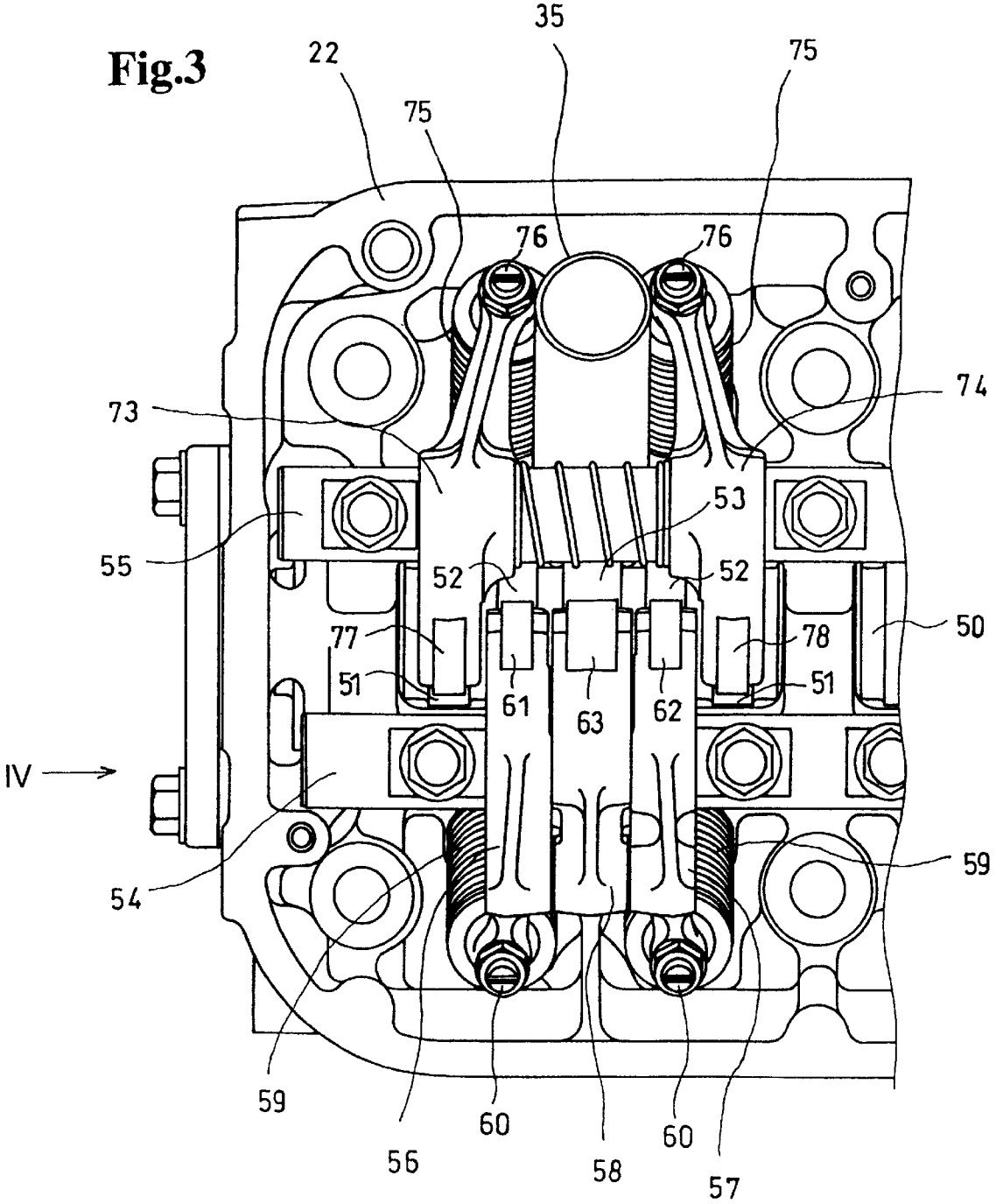
FIG. 3 is a fragmentary back view of cylinder heads, with a head cover being removed.
Figure 4:
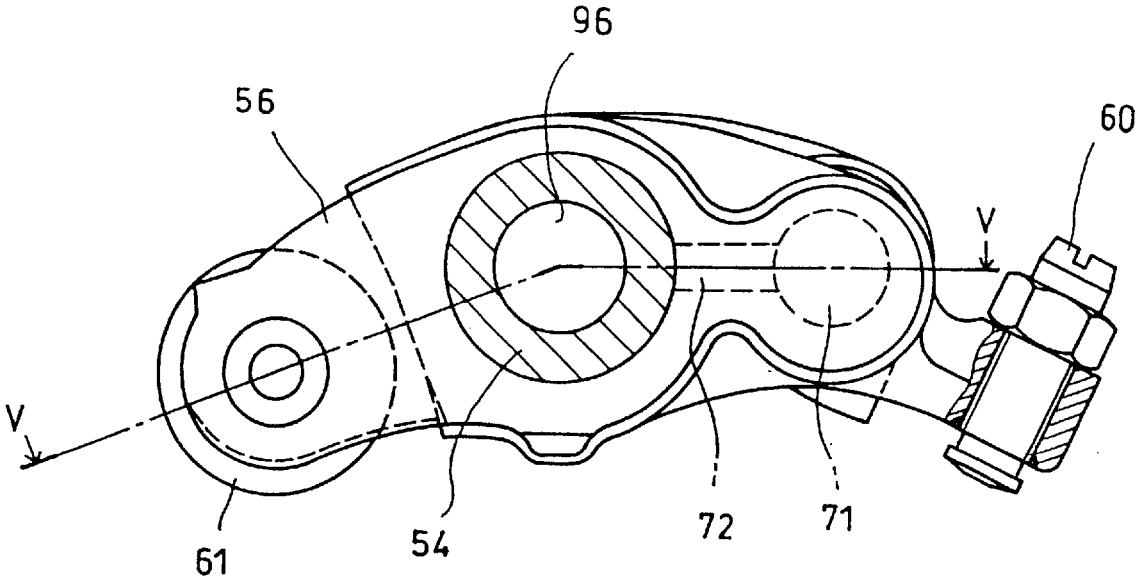
FIG. 4 is a diagram of an intake rocker arm, viewed from the arrow IV of FIG. 3.
Figure 5:
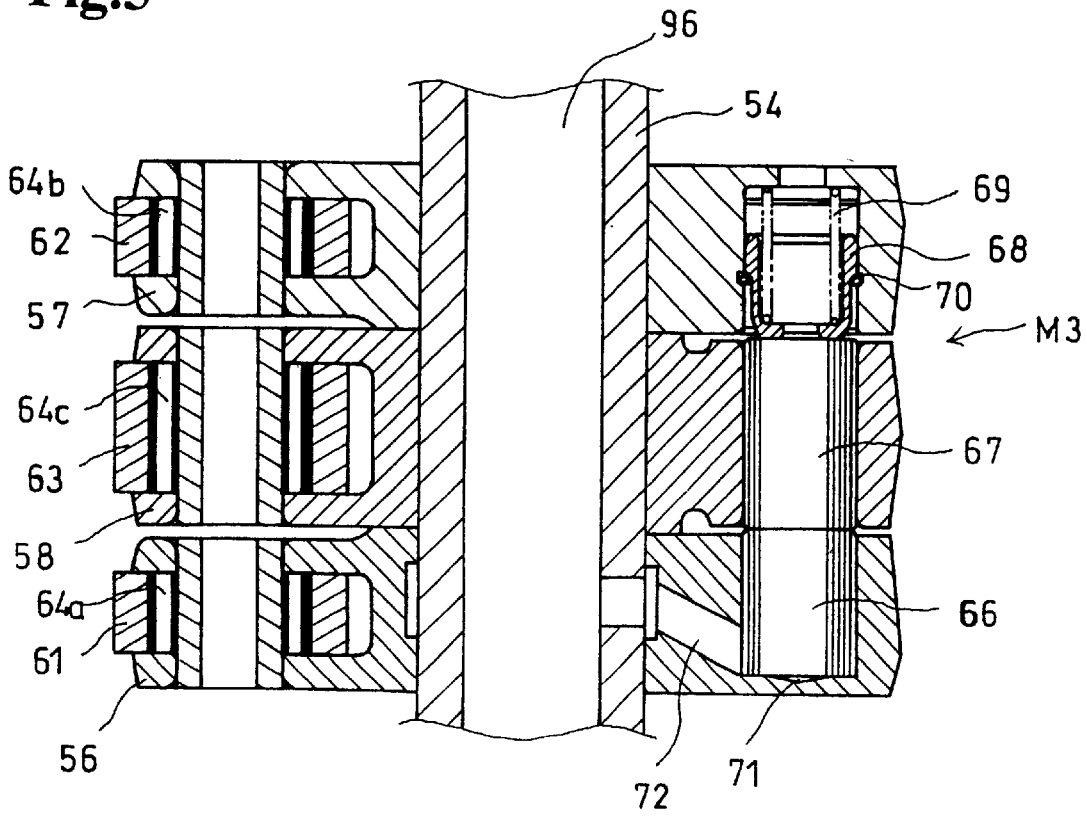
FIG. 5 is a cross-sectional view taken along the V—V line of FIG. 4.

Referring to FIGS. 3 through 5, each cam shaft 50 has formed, for each cylinder 25, a pair of exhaust cams 51, a pair of low-speed intake cams 52 located between the exhaust cams 51, and a high-speed intake cam 53 located between the low-speed intake cams 52. Each low-speed intake cam 52 has a nose portion having a relatively small projecting amount and a relatively small operating angle, and a base circular portion. The high-speed intake cam 53 has a nose portion having a larger projecting amount and a larger operating angle than those of the low-speed intake cam 52, and a base circular portion. Each exhaust cam 51 has a nose portion having a predetermined projecting amount and a predetermined operating angle, and a base circular portion.

The intake rocker shaft 54 behind the cam shaft 50 swingingly supports first and second intake rocker arms 56, 57 and third rocker arm 58 with their central portions at positions corresponding to both low-speed intake cams 52 and high-speed intake cam 53, respectively. At one end of each of the first and second intake rocker arms 56, 57, a tappet screw 60 abutting the tip of the intake valve 33 biased toward the closing direction by a valve spring 59 is provided for extending and retracting movements. At the other ends of the first to third intake rocker arms 56, 57, 58, first to third rollers 61, 62, 63 in slidable contact with both low-speed intake cams 52 and high-speed intake cam 53, respectively, are supported via a number of roller bearings 64*a*, 64*b*, 64*c*. The third intake rocker arm 58 is biased by a spring-biasing means 65 having a spring (see FIG. 2) such that the third roller 63 slidably contacts the high-speed intake cam 53.

Referring to FIGS. 4 and 5, a link switching mechanism M3, which is a hydraulic activator, is provided between the intake rocker shaft 54 and each one end of the first and second intake rocker arms 56, 57 and between the intake rocker shaft 54 and one end of the third intake rocker arm 58 to enable changeover of connection and disconnection of these three. The link switching mechanism M3 includes a connection piston 66 for connecting the first and third intake rocker arms 56, 58, a connection pin 67 for connecting the second and third intake rocker arms 57, 58, a regulating member 68 for regulating movements of the connection piston 66 and the connection pin 67, and a return spring 69 biasing the connection piston 66, connection pin 67 and regulating member 68 toward their disconnection sides. Reference numeral 70 denotes a stop ring that regulates the projecting position of the regulating member 68.

The connection piston 66 slidably engages in the first intake rocker arm 56. A hydraulic chamber 71 is formed between one end of the connection piston 66 and the first intake rocker arm 56, and a communication path 72 communicating with the hydraulic chamber 71 is provided in the first intake rocker arm 56. Inside the intake rocker shaft 54, an intake-side oil supply path 96 is formed to communicate with a hydraulic oil path, which will be explained later, and the intake-side oil supply path 96 always communicated with the hydraulic chamber 71 via the communication path 72 regardless of any swinging condition of the first intake rocker arm 56.

The connection pin 67 having one end abutting the other end of the connection piston 66 slidably engages in the third intake rocker arm 58 whereas the regulating member 68 having a bottom-closed cylindrical shape abutting the other end of the connection pin 67 slidably engages in the second intake rocker arm 57. The return spring 69 is mounted compressed between the second intake rocker arm 57 and the regulating member 68.

In the link switching mechanism M3, when the hydraulic oil pressure in the hydraulic chamber 71 decreases, the connection piston 66, connection pin 67 and regulating member 68 move to their disconnection sides with the spring force from the return spring 69. In this status, abutting surfaces of the connection piston 66 and the connection pin 67 lie between the first and third intake rocker arms 56, 58, abutting surfaces of the connection pin 67 and the regulating member 68 lie between the second and third intake rocker arms 57, 58, and the first to third intake rocker arms 56, 57, 58 are held disconnected. When high-pressure hydraulic oil is supplied to the hydraulic chamber 71, the connection piston 66, connection pin 67 and regulating member 68 move to their connection sides against the spring force of the return spring 69. As a result, the connection piston 66 engages the third intake rocker arm 58, the connection pin 67 engages the second intake rocker arm 57, and the first to third intake rocker arms 56, 57, 58 get connected integrally.

Therefore, the valve operating characteristics variable mechanism M2 is made up of both low-speed intake cams 52, high-speed intake cam 53, first to third rocker arms 56, 57, 58 and link switching mechanism M3.

On the other hand, the exhaust rocker shaft 55 located behind the cam shaft 50 swingingly supports the first and second exhaust rocker arms 73, 74 with their central portions at positions associated with both exhaust cams 51, respectively. At one end of each of the first and second exhaust rocker arms 73, 74, a tappet screw 76 abutting the tip of the exhaust valve 34 biased toward the closing direction by a valve spring 75 is provided for extending and retracting movements. At the other ends of the first and second exhaust rocker arms 73, 74, first and second rollers 77, 78 in slidable contact with both exhaust cams 51 are supported via a number of roller bearings.

Referring back to FIG. 2, at the other end of each intake port having formed a pair of intake openings 31 at one end, the downstream end of an intake manifold having formed a fuel injection valve is connected, and air for combustion is supplied through an air intake opening 8*a* of the engine cover 8, duct 79 in the engine cover 8, intake silencer 80, throttle body 81, intake resonance device 82, intake manifold and intake port together with the fuel injected from the fuel injection valve to each combustion chamber 30.

On the other hand, at the other end of each exhaust port having a pair exhaust openings 32 at one end, the upstream end of the exhaust manifold is connected, and combustion gas from each combustion chamber 30 is discharged from the exhaust opening into the water through the exhaust port, exhaust manifold, exhaust tube 83, extension case 6 and gear case 9.

At the bottom end of the crank shaft 24 projecting downward from the lower seal cover 27 forming a part of the crank chamber 28, a flywheel 84 is united with bolts. To the bottom surface of the flywheel 84, a flange portion of a cylindrical spline piece 85 is connected, and the top end of the drive shaft 14 is brought into spline coupling to the spline formed on the inner circumferential surface of the spline piece 85. The flywheel 84 is held in a flywheel chamber 87 defined by the lower seal cover 27, part of the lower wall portion of the cylinder block 21 and part of the lower wall portion of the crank case 20, as its upper wall, and a pump body 86*a* of the oil pump 86, as its lower wall.

In the lower wall portion forming the bottom surface of the engine body 3, the lower wall portion of the cylinder block 21 and the lower wall portion of the crank case 20 are connected together with the pump body 86*a* to the mount case 4 with a plurality of bolts, interposing the pump body 86*a*. Therefore, in this embodiment, the lower wall portion of the engine body 3 is used as a mount wall portion.

Figure 6:
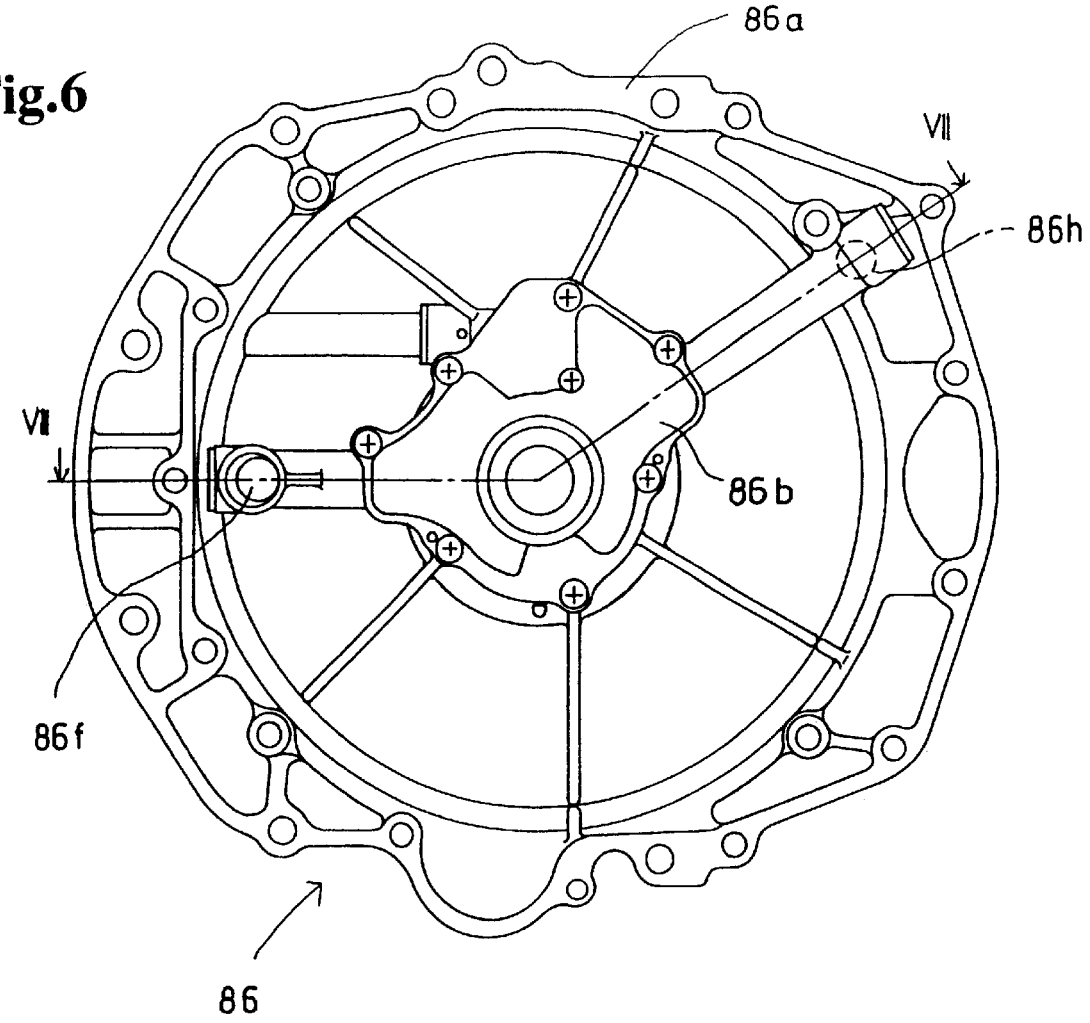
FIG. 6 is a bottom view of an oil pump.
Figure 7:
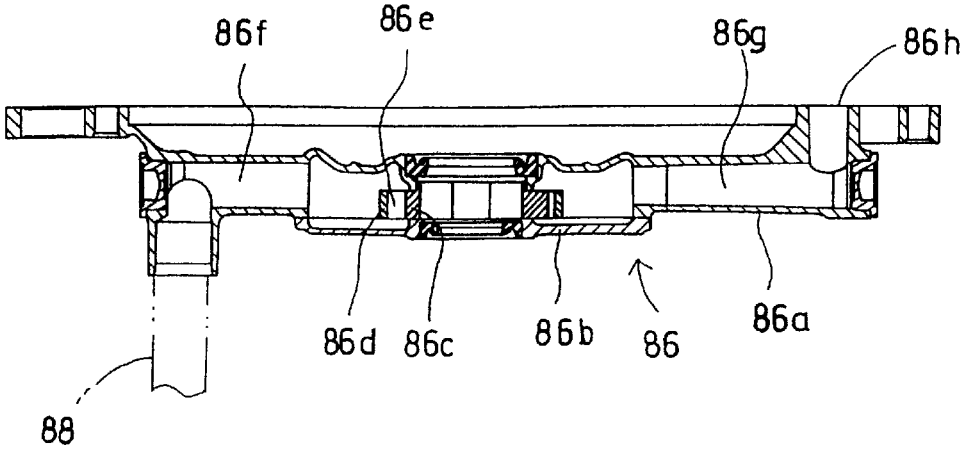
FIG. 7 is a cross-sectional view taken along the VII—VII line of FIG. 6.
Figure 10:
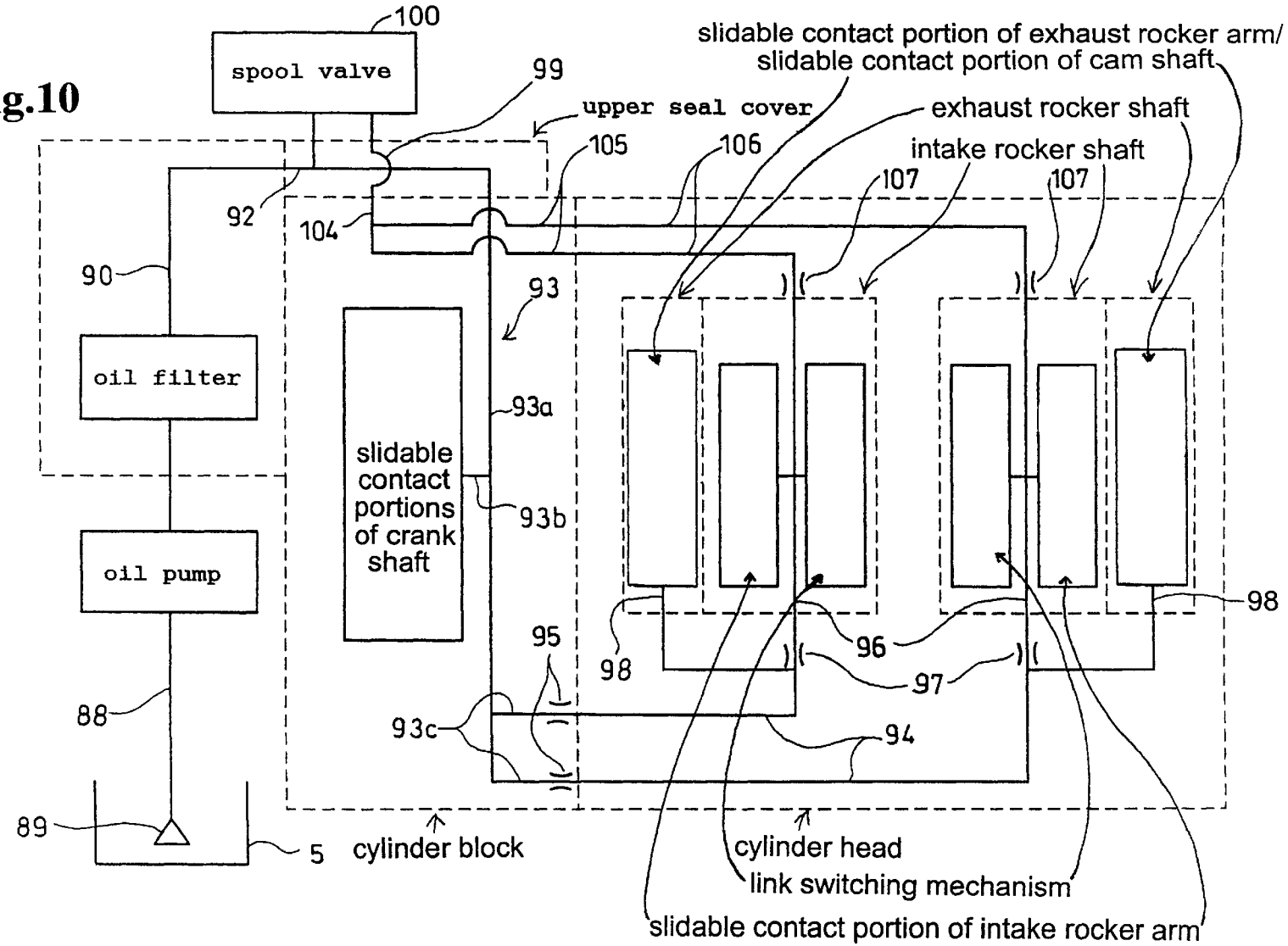
FIG. 10 is an explanatory diagram of oil paths of lubricant oil and hydraulic oil.

Next referring to FIGS. 6 and 10 in conjunction, the lubrication system of the engine 2 is explained. As shown in FIGS. 6 and 7, the oil pump 86 of a trochoidal type located adjacent to the lower part of the flywheel chamber 87 includes a pump body 86*a*, pump cover 86*b* fixed to the pump body 86*a* with bolts, inner rotor 86*c* integrally united to the spline piece 85 and driven by the crank shaft 24, and an outer rotor 86*d* abutting and rotating with the inner rotor 86*c*. Both rotors 86*c*, 86*d* are located in a space defined by the pump body 86*a* and the pump cover 86*b*, and a plurality of pump chambers 86*e* are formed between the rotors 86*c*, 86*d*.

Figure 8:
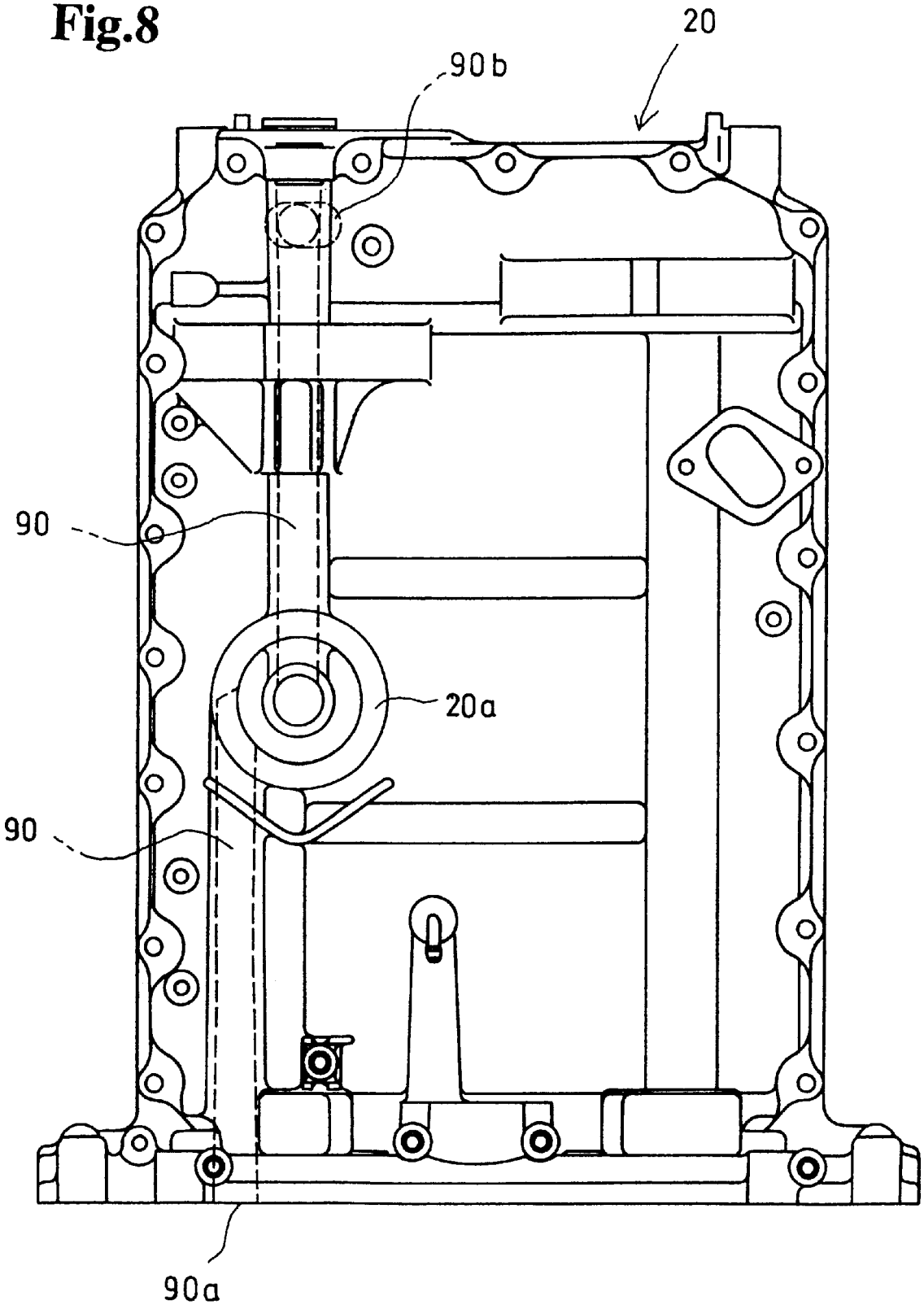
FIG. 8 is a front view of a crank case.

A suction port 86*f* and a discharge port 86*g* are formed in the pump body 86*a*. Top end of a suction tube 88 (see FIG. 2) is connected to the suction port 86*f*. The suction tube 88 extends downward within the oil pan 5, and connected to its lower end is a strainer 89 (see FIG. 10). An outlet opening 86*h* of the discharge port 86*g* is connected to an inlet opening 90*a* of a case oil path 90 provided in the crank case 20 to open at the bottom surface thereof as shown in FIG. 2 or FIG. 8. An outlet opening 90*b* located to the top end of the case oil path 90 opens at the fitting surface with the upper seal cover 26. In the midway of the case oil path 90, there is an oil filter 91 attached to a mount seat 20*a* provided on the front surface of the crank case 20, which forms the front wall portion of the engine body 3. Lubricant oil flowing through the case oil path 90 gets free from foreign matters mixed therein when it passes the oil filter 91, and becomes clean lubricant oil.

Figure 9:
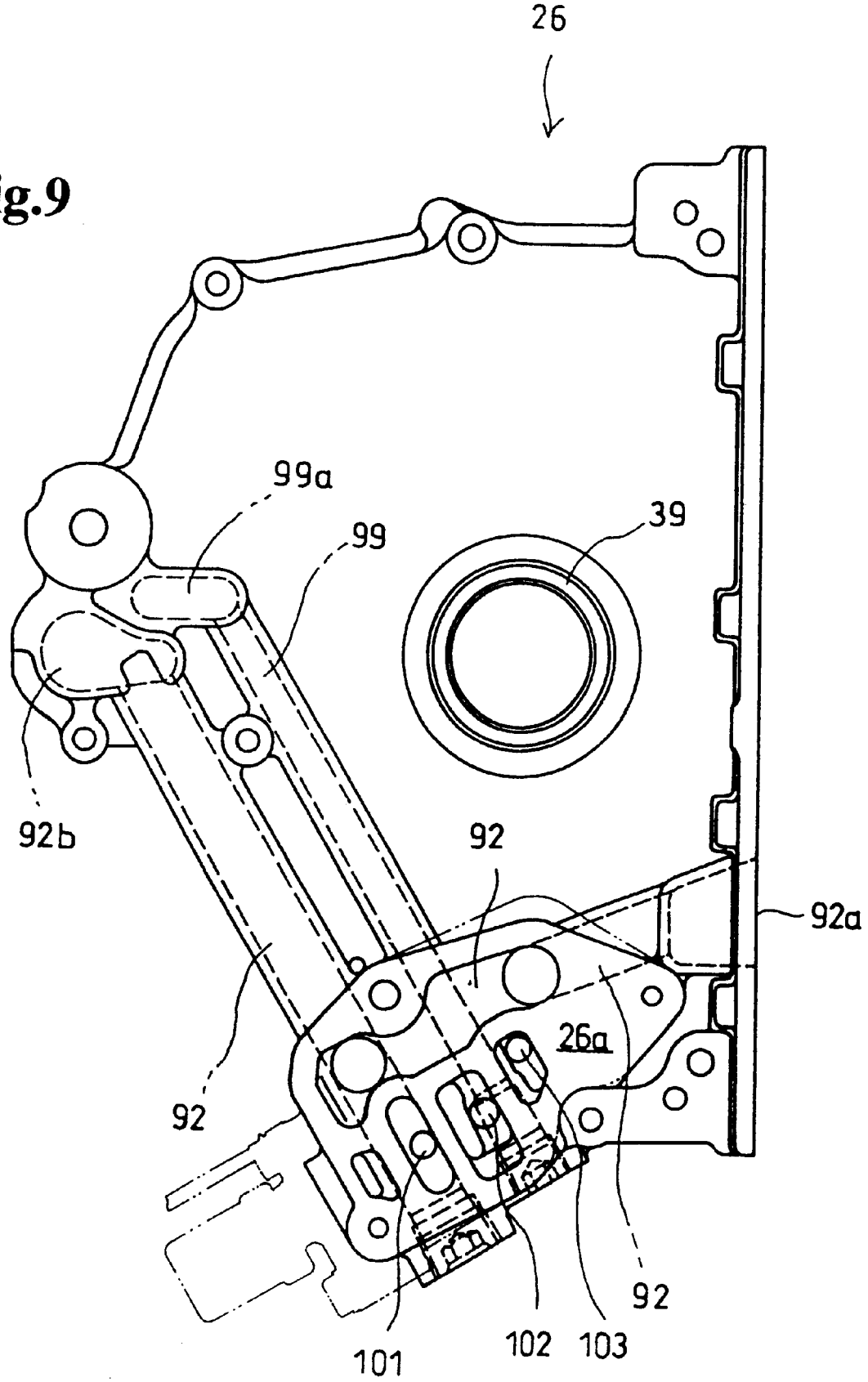
FIG. 9 is a top view of an upper seal cover.

As shown in FIG. 9, the case oil path 90 is connected to an inlet opening 92*a* of a cover oil path 92 (see FIG. 2 as well) that is provided in the upper seal cover 26 to open at the fitting surface with the crank case 20, and an outlet opening 92*b* of the cover oil path 92 opening at the fitting surface of the upper seal cover 26 for fitting the cylinder block 21 is connected to an inlet opening of a block oil path 93 (see FIG. 10) that is provided at the crossing of the cylinders 25 of both banks to open at the fitting surface with the upper seal cover 26.

Referring to FIG. 10, the block oil path 93 provided in the cylinder block 21 is made up of a main oil path 93*a* having the inlet opening and linearly extending vertically, four journal oil paths 93*b* branching from the main oil path 93*a* and communicating with four bearing portions of the crank shaft 24, respectively, and a pair of outlet oil paths 93*c* branching from a lower portion of the main oil path 93*a*, then extending through an orifice 95, opening at the fitting surface with the cylinder head 22 and communicating with a pair of head oil paths 94 formed in the cylinder head 23 and opening at the fitting surface with the cylinder block 21, respectively. Part of the lubricant oil supplied to the bearing portions of the crank shaft 24 flows through an oil hole formed inside the crank shaft 24 and extrudes from the outer circumferential surface of the crank pin to lubricate the junction between the cranks pin and the large end portion of the conrod 37. Therefore, the block oil path 93 functions as an oil path for supplying lubricant oil to slide portions of the crank shaft 24 that are the bearing portions and to junctions of the crank shaft 24.

The pair of head oil paths 94 formed in the cylinder head 22 are connected to the intake-side oil supply path 96 provided inside the intake rocker shaft 54 in each bank via an orifice 97, and connected to an exhaust-side oil supply path 98 provided inside the exhaust rocker shaft 55. Lubricant oil supplied from the head oil paths 94 to the intake-side oil supply path 96 is partly supplied as low-pressure hydraulic oil to the hydraulic chamber 71 of the link switching mechanism M3 when an inlet port 101 and an outlet port 102 of the mount seat 26*a* of the hydraulic control valve, which will be explained later, are closed, and the remainder of the lubricant oil is supplied to lubricate slidable contact portions between the intake rocker shaft 54 and the first to third intake rocker arms 56, 57, 58.

On the other hand, lubricant oil supplied from the head oil paths 94 to the exhaust-side supply path 98 is partly supplied as lubricant oil to a bearing portion that rotatably supports the journal portion of the cam shaft 50, and the remainder of the lubricant oil is supplied as lubricant oil to slidable contact portions between the exhaust rocker shaft 55 and the first and second exhaust rocker arms 73, 74. Therefore, the pair of head oil paths 94 function to supply lubricant oil to the valve driving mechanism M1, the intake-side oil supply path 96 functions to supply lubricant oil to slidable portions of respective intake rocker arms 56, 57, 58, and the exhaust-side oil supply path 98 functions to supply lubricant oil to slidable portions of respective rocker arms 73, 74 and cam shaft 50. Both orifices 95, 97 serve to regulate the amount of lubricant oil necessary for lubricating the valve driving mechanism M1.

Since the case oil path 90, cover oil path 92, block oil path 93 and head oil path 94 are oil paths formed in the crank case 20, upper seal cover 26, cylinder block 21 and cylinder head 22, respectively, which are elements forming the engine body 3, they make up the engine body oil path. In this embodiment, the engine body oil path serves as the lubricant oil path. Lubricant oil after lubricating slidable portions of the crank shaft 24 and lubricant oil after lubricating the valve driving mechanism M1 run through the return oil path and drop into the oil pan 5.

Referring to FIGS. 9 and 10, the upper seal cover 26 forming a part of the top wall of the engine body 3 has formed a cover hydraulic oil path 99 that forms a part of a hydraulic oil path for supplying hydraulic oil to the link switching mechanism M3 of the valve operating characteristics variable mechanism M2. The cover hydraulic oil path 99 is connected to or disconnected from the cover oil path 92 via a spool valve 100 (shown by a two-dot chain line in FIG. 9) that is a hydraulic control valve mounted to the upper seal cover 26. That is, the spool valve 100 mounted to the mount seat 26*a* provided on the top surface of the upper seal cover 26 is driven by a drive signal from a control device in accordance with the revolution speed of the engine to connect or disconnect an entrance port 101, exit port 102 and drain port 103 formed in the mount seat 26*a*. The spool valve 100 can be mounted to the upper seal cover 26 beforehand to form an integral unit of these both. In this manner, by simply coupling the upper seal cover 26 to the cylinder block 21 and the crank case 20, a hydraulic oil path, explained later, having the cover oil path 92 connected to the case oil path 90 and also connected to the block oil path 93, is completed. The spool valve 100 is either of a hydraulic type driven by a pilot hydraulic pressure controlled by an electromagnetic valve or of an electromagnetic type driven by an electromagnetic drive means like a linear solenoid.

More specifically, the outlet opening 99*a* of the cover hydraulic oil path 99 opening at the fitting surface between the upper seal cover 26 and the cylinder block 21 is connected to an inlet opening of a block hydraulic oil path 104 that is formed in the cylinder head 22 to open at the fitting surface with the upper seal cover 26. As shown in FIG. 10, the block hydraulic oil path 104 is bifurcated to a pair of branch hydraulic oil paths 105 inside the cylinder block 21. Both these branched hydraulic oil paths 105 open at fitting surfaces with the cylinder head 22, and communicate with a pair of head hydraulic oil paths 106, respectively, which are formed in the cylinder head 22 and open at fitting surfaces with the cylinder block 21. Both head hydraulic oil paths 106 are connected to intake-side oil supply paths 96 of both banks respectively, through the orifice 107.

The cover hydraulic oil path 99, block hydraulic oil path 104, pair of branched hydraulic oil paths 105 and pair of head hydraulic oil paths 106 make up the hydraulic oil path for supplying the link switching mechanism M3 with hydraulic oil.

In a low revolution range lower than a predetermined revolution speed of the engine, a drain port 103 opening into the crank chamber 28 and an exit port 102 communicating with the cover hydraulic oil path 99 are connected through a groove in the spool valve 100, and the entrance port 101 and the exit port 102 communicating with the cover oil path 92 are disconnected by a land of the spool valve 100, which permits the hydraulic oil to be released from the hydraulic oil path to the crank chamber 28. Therefore, hydraulic pressure in the hydraulic oil path decreases, and hydraulic pressure in the hydraulic chamber 71 of the link switching mechanism M3 decreases as well. However, the low pressure is maintained by lubricant oil supplied through the head oil path 94. In a high revolution range higher than the predetermined revolution speed of the engine, the entrance port 101 and the exit port 102 are connected via the groove in the spool valve, and the exit port 102 and the drain port 103 are disconnected by the land of the spool valve 100, thereby to permit lubricant oil to be supplied from the cover oil path 92 to the hydraulic oil path and permit high-pressure hydraulic oil to be supplied to the hydraulic chamber 71. The orifice 107 is provided to prevent excessive flow of hydraulic oil from the intake-side oil supply path 96 when the exit port 102 gets in communication with the drain port 103.

Therefore, when the entrance port 101 and the exit port 102 are in communication, since a part of the lubricant oil in the cover oil path 92 flows to the hydraulic oil path, the mount seat 26*a* having formed the entrance port 101, exit port 102 and drain port 103 constitutes a branch portion where the cover hydraulic oil path 99, i.e. hydraulic oil path, branches from the cover oil path 92.

Next explained are behaviors of the valve operating characteristics variable mechanism M2.

When the engine 2 is driven in a low revolution range, since the spool valve 100 makes communication between the exit port 102 and the drain port 103 in response to a drive signal from the control device, oil pressure in the hydraulic chamber 71 of the link switching mechanism M3 decreases to a low pressure, and the connection piston 66 and the regulating member 68 of the link switching mechanism M3 take their disconnection positions shown in FIG. 5 with the resilient force of the return spring 69. Therefore, the first to third intake rocker arms 56, 57, 58 are disconnected from each other, and the pair of intake valves 33 are opened and closed by the first and second intake rocker arms 56, 57 with the first and second rollers 61, 62 being in slidable contact with both low-speed intake cams 52, respectively. At that time, the third intake rocker arm 58, with the third roller 63 in slidable contact with the high-speed intake cam 53, makes a lost motion irrespectively of operations of the intake valve 33. Under the status, the pair of exhaust valves 34 are opened and closed by the first and second exhaust rocker arms 73, 74 with the first and second roller 77, 78 in contact with both exhaust cams 51, respectively. Therefore, in the low revolution range of the engine 2, the pair of intake valves 33 are opened by a small lifting amount for a short opening period both suitable for the low revolution range to obtain a high volumetric efficiency, and this ensures a high output in the low revolution range.

Once the revolution speed of the engine shifts to a high revolution range, since the spool valve 100 makes communication between the exit port 102 and the entrance port 101 in response to a drive signal from the control device, hydraulic pressure in the hydraulic chamber 71 of the link switching mechanism M3 increases to a high pressure, and the connection piston 66, connection pin 67 and regulating member 68 move to their connection positions against the biasing force of the return spring 69 to integrally connect the first to third intake rocker arms 56, 57, 58. As a result, swinging movements of the third intake rocker arm 58 with the third roller 63 in slidable contact with the high-speed intake cam 53 are transmitted to the first and second intake rocker arms 56, 57 now integrally connected thereto, and the pair of intake valves 33 are opened and closed.. At that time, nose portions of both low-speed intake cams 52 are apart from the first and second roller 61, 62 of the first and second intake rocker arms 56, 57 and make a lost motion. In this status, the pair of exhaust valves 34 are opened and closed by operating characteristics of both exhaust cams 51 similarly to the case in the low revolution range. Therefore, in the high revolution range of the engine 2, the pair of intake valves 33 are opened by a large lifting amount for a long opening period both suitable for the large revolution range to obtain a high volumetric efficiency, and this ensures a high output in the high revolution range.

The lubricating system is reviewed below. When the engine 2 is driven and the oil pump 86 is driven by the crank shaft 24, lubricant oil, which is suctioned from the oil pan 5 into the pump chamber 86*e* through the suction tube 88 and suction port 86*f* and then discharged from the outlet port 86*g*, is sent under pressure to the case oil path 90 as shown in FIG. 10, then cleaned through the oil filter 91, and thereafter flows into the block oil path 93 via the cover oil path 92. The lubricant oil in the block oil path 93 is supplied to bearing portions of the crank shaft 24 from the journal oil path 93*b* and lubricates the bearing portions. Then, a part of the lubricant oil supplied to the bearing portions of the crank shaft 24 lubricates the junction between the crank pin and the large end portion of the conrod 37.

Part of the lubricant oil sent from the block oil path 93 to the head oil path 94 flows into the intake-side oil supply path 96, and it is supplied from the intake-side oil supply path 96 to slidable contact portions with the intake rocker shafts 54 of the respective intake rocker arms 56, 57, 58 to lubricate these slidable contact portions, and part of the lubricant oil flowing into the intake-side oil supply path 96 flows into the hydraulic chamber 71 of the link switching mechanism M3 to fill the hydraulic chamber 71 with the low-pressure lubricant oil in the low revolution range. Similarly, the remainder of the lubricant oil sent to the head oil path 94 flows into the exhaust-side oil supply path 98, and a part thereof is supplied to the bearing portion of the cam shaft 50 to lubricate the bearing portion while the remainder thereof is supplied from the exhaust-side oil supply path 98 to the slidable contact portions of the respective rocker arms 73, 74 with the exhaust rocker shaft 55.

Next explained are operations and effects of the embodiment having the above-explained configuration.

The pair of intake valves 33 of each cylinder 25 are changed in their operating characteristics by the valve operating characteristics variable mechanism M2 in accordance with the revolution speed of the engine, such as being opened by a small lifting amount for a short opening period in the low revolution range, or by a large lifting amount for a longer opening period in the high revolution range. Therefore, in different revolution ranges of the engine, respective outputs are improved, and the fuel consumption efficiency can be improved. In addition, since the spool valve 100 is mounted to the upper seal cover 26 that is the upper wall portion of the engine body 3, other than the lower wall portion attached to the mount case 4, maintenance of the spool valve 100 is possible without removing the engine 2. Moreover, because it is attached to the upper wall portion, maintenance of the spool valve 100 is easier.

Further, since the spool valve 100 is located at the branching portion of the hydraulic oil path branching from the lubricant oil path for supplying lubricant oil to the bearing portions of the crank shaft 24 and the valve driving mechanism M1, the hydraulic oil path made up of the cover hydraulic oil path 99 from the spool valve 100, block hydraulic oil path 104, pair of branched hydraulic oil paths 105 and pair of head hydraulic oil paths 106 can be shortened. As a result, the portion spanning from the oil pump 86 to the branching portion, which can be commonly used as the oil path of the lubricant oil for lubrication and as the oil path of the hydraulic oil is elongated, which contributes to simplifying arrangement of the lubricant oil path and the hydraulic oil path made up of the case oil path 90, cover oil path 92, block oil path 93 and head oil path 94, and also prevents an increase of the cost caused by making the hydraulic oil path.

Since the hydraulic oil flowing in the hydraulic oil path is lubricant oil of the oil path branched at the branching portion from the cover oil path 92 located downstream of the case oil path 90 having the oil filter 91 therein, it is a clean lubricant oil freed from foreign matters, etc. by the oil filter 91. As a result, foreign matters once entering into the lubricant oil do not intrude to the spool valve 100 and the valve operating characteristics variable mechanism M2, and these components keep properly operative for a longer period, which also makes the maintenance easier.

Since the oil filter 91 is attached on the front face of the crank case 20 forming the front wall portion of the engine body 3, the oil filter 91 lies in front of the crank case 20 in a front portion of the outboard motor 1, and the oil filter 91 can be removed or attached easily, thereby to facilitate its maintenance.

Since the use of the bearing cap 38 makes it possible to precisely set the leakage of lubricant oil at the bearing portion, it contributes to improving the accuracy of the bearing and easily ensuring rigidity of the bearing portion.

When the spool valve 100 is previously attached integrally to the mount seat 26*a* of the upper seal cover 26, the spool valve 100 and the upper seal cover 26 can be formed as a unit, thereby to facilitate attachment of the spool valve 100 in the engine body 3.

Furthermore, since the drain port 103 is formed in the upper seal cover 26 having the hole through which the top end of the crank shaft 24 passes, when the exit port 102 and the drain port 103 are connected by the spool valve 100, hydraulic oil in the hydraulic oil path is released from the drain port 103 to the crank chamber 28 and can be supplied as lubricant oil to the bearing portions of the crank shaft 24 and slidable contact portion of the piston 29, which are contained in the crank chamber 28.

Explanation is made below regarding structures partly modified from the above-explained embodiment.

Although the valve operating characteristics variable mechanism M2 in the foregoing embodiment has been explained as opening and closing the pair of intake valves 33 in a low revolution range, it can be modified to open and close one of the pair of intake valves 33 in the low revolution range while maintaining the other closed. Thereby, it is possible to generate swirling in the combustion chamber 30 in the low revolution range and improve the combustion efficiency. Further, the foregoing embodiment includes the valve operating characteristics variable mechanism M2 only for the intake valves 33, but it may be provided for both the intake valves 33 and the exhaust valves 34, or only for the exhaust valves 34.

Although the lubricant oil path in the foregoing embodiment is the engine body oil path formed in the engine body 3, a part of the lubricant oil path may be formed in one or more members other than the engine body 3, such as mount case 4. The engine 2 having explained as being a V-type cylinder engine may be a serial type cylinder engine.

Furthermore, although the branching portion is formed in the upper seal cover 26 in the foregoing embodiment, it may be formed in the upper wall portion of the cylinder block or the upper wall portion of the cylinder head 22, which constitutes the upper wall portion of the engine body 3.

It will be understood by persons skilled in the art that variations and modifications may be made to present embodiments of the invention described above, without departing from the gist, spirit or essence of the invention. The scope of the invention is indicated by the appended claims.

What is claimed is:

1. An outboard motor comprising:

a mount case;

an engine which includes an engine body mounted to said mount case with a mount wall portion of the engine body and defining a crank chamber containing a vertically extending crank shaft and bearing portions rotatably supporting the crank shaft, an intake valve and an exhaust valve for opening and closing an intake opening and an exhaust opening, respectively, which open to a combustion chamber; a valve driving mechanism for opening and closing the intake valve and the exhaust valve;

at least one of said intake valve and said exhaust valve including a plurality of such valves for each cylinder of the engine; said valve driving mechanism including a hydraulic-driven valve operating characteristics variable mechanism which changes operating characteristics of at least one intake valve or exhaust valve among said plurality of intake valves or exhaust valves in accordance with the revolution speed of the engine;

an oil pump driven by said engine; an hydraulic oil path for supplying said valve operating characteristics variable mechanism with hydraulic oil being branched at a branching portion from a lubricant oil path for supplying said bearing portions and said valve driving mechanism with lubricant oil released from said oil pump;

said branching portion being formed in a wall portion of said engine body other than said mount wall portion; and an hydraulic control valve for controlling pressure of hydraulic oil at said branching portion.

2. An outboard motor according to claim 1, wherein an engine body oil path forming a part of said lubricant oil path and an oil filter for lubricant oil flowing in said engine body oil path to pass through are provided in said engine body, and said branching portion being located in said lubricant oil path downstream of said oil filter.

3. An outboard motor according to claim 2, wherein said engine body includes a cylinder block and a crank case which partly define said crank chamber, each said bearing portion being made up of said cylinder block and a bearing cap, and said oil filter being disposed in said crank case which constitutes a front wall portion of said engine body.

4. An outboard motor according to claim 3, wherein said cylinder block has a deep skirt portion, and said wall portion is a cover which is fixed to said cylinder block to form a part of a top wall portion of said engine body and permits said crank shaft projecting from said crank chamber to pass through, said engine body oil path including a case oil path formed in said crank case, a block oil path formed in said cylinder block, and a cover oil path formed in said cover, said case oil path being connected to said block oil path via said cover oil path.

5. An outboard motor according to claim 2, wherein said oil filter is disposed on a front surface of said crank case.

6. An outboard motor according to claim 1, wherein said mount wall portion is a lower portion of said engine body.

7. An outboard motor according to claim 1, wherein said hydraulic control valve is a spool valve.

8. An outboard motor comprising:

a mount case;

an engine having an engine body, a vertically extending crank shaft, bearing portions rotatably supporting the crank shaft, intake and exhaust valves for opening and closing intake and exhaust openings respectively, which open to a combustion chamber, and a valve driving mechanism for opening and closing the intake and exhaust valves;

said engine body having a mount wall portion mounted to said mount case and defining a crank chamber containing said crank shaft;

said valve driving mechanism including an hydraulic-driven valve operating characteristics variable mechanism which changes operating characteristics of at least one of said intake and exhaust valves based on a revolution speed of said engine;

a lubrication system for lubricating said engine, including an oil pump driver by said engine, an hydraulic oil path for supplying said valve operating characteristics variable mechanism with hydraulic oil, a lubricant oil path for supplying said bearing portions and said valve driving mechanism with lubricant oil released from said oil pump, a branching portion between the hydraulic oil path and the lubricant oil path, and an hydraulic control valve which controls pressure of hydraulic oil at said branching portion;

said branching portion being formed in a wall portion of said engine body other than said mount wall portion.

9. An outboard motor according to claim 8, wherein an engine body oil path forming a part of said lubricant oil path and an oil filter for lubricant oil flowing in said engine body oil path to pass through are provided in said engine body, and said branching portion being located in said lubricant oil path downstream of said oil filter.

10. An outboard motor according to claim 9, wherein said engine body includes a cylinder block and a crank case which partly define said crank chamber, each said bearing portion being made up of said cylinder block and a bearing cap, and said oil filter being disposed in said crank case which constitutes a front wall portion of said engine body.

11. An outboard motor according to claim 10, wherein said cylinder block has a deed skirt portion, and said wall portion is a cover which is fixed to said cylinder block to form a part of a top wall portion of said engine body and permits said crank shaft projecting from said crank chamber to pass through, said engine body oil path including a case oil path formed in said crank case, a block oil path formed in said cylinder block, and a cover oil path formed in said cover, said case oil path being connected to said block oil path via said cover oil path.

12. An outboard motor according to claim 9, wherein said oil filter is disposed on a front surface of said crank case.

13. An outboard motor according to claim 8, wherein said amount wall portion is a lower portion of said engine body.

14. An outboard motor according to claim 8, wherein said hydraulic control valve is a spool valve.

* * * * *

UNITED STATES PATENT AND TRADEMARK OFFICE

CERTIFICATE OF CORRECTION

PATENT NO. : 6,484,681 B2
DATED : November 26, 2002
INVENTOR(S) : Tatsuya Kuroda It is certified that error appears in the above-identified patent and that said Letters Patent is hereby corrected as shown below:

Column 4,
Line 10, delete “be”.
Line numbered between 30 and 31, change “crank case, 20,” to -- crank case 20, --.

Column 5,
Line 4, change “opening 32” to -- openings 32 --.

Column 7,
Line numbered between 25 and 26, after “pair” insert -- of --.

Column 8,
Line 38, change “cranks” to -- crank --.

Column 11,
Line 1, change “closed..” to -- closed. --.

Column 14,
Line 26, change “driver” to -- driven --.
Line numbered between 50 and 51, change “deed” to -- deep --.
Line numbered between 62 and 63, change “amount” to -- mount --.

Signed and Sealed this

Eleventh Day of March, 2003

JAMES E. ROGAN
*Director of the United States Patent and Trademark Office*